US007155999B1

(12) United States Patent
Helfet

(10) Patent No.: US 7,155,999 B1
(45) Date of Patent: Jan. 2, 2007

(54) STRAP WRENCH FOR GRIPPING AND TURNING GENERALLY CYLINDRICAL OBJECTS

(76) Inventor: Leon Helfet, 1539 San Rafael Way, Camarillo, CA (US) 93012

( * ) Notice: Subject to any disclaimer, the term of this patent is extended or adjusted under 35 U.S.C. 154(b) by 0 days.

(21) Appl. No.: 11/231,446

(22) Filed: Sep. 20, 2005

Related U.S. Application Data

(60) Provisional application No. 60/615,381, filed on Oct. 1, 2004.

(51) Int. Cl.
*B25B 13/52* (2006.01)

(52) U.S. Cl. ..... 81/64; 81/3.4; 81/3.43; 81/65

(58) Field of Classification Search ..... 81/3.4, 81/3.43, 64, 65
See application file for complete search history.

(56) References Cited

U.S. PATENT DOCUMENTS

| | | | | |
|---|---|---|---|---|
| 2,718,166 | A | 9/1955 | Hollenbeck | |
| 3,133,463 | A | 5/1964 | Davis, III | |
| 3,851,548 | A | 12/1974 | Rutz | |
| 4,150,591 | A * | 4/1979 | Ackeret | 81/3.43 |
| 4,532,833 | A | 8/1985 | Downs | |
| 5,432,978 | A | 7/1995 | Menke et al. | |
| 5,458,027 | A * | 10/1995 | Rambin | 81/64 |
| 6,789,450 | B1 | 9/2004 | Helfet | |
| 6,851,335 | B1 * | 2/2005 | Johnson | 81/64 |

FOREIGN PATENT DOCUMENTS

| | | |
|---|---|---|
| EP | 618 045 A1 | 3/1994 |

* cited by examiner

*Primary Examiner*—Lee D. Wilson
*Assistant Examiner*—Shantese McDonald
(74) *Attorney, Agent, or Firm*—Jack C. Munro; Sandy Lipkin

(57) ABSTRACT

A strap wrench which includes a plurality of gripping pads located on the strap that facilitates tight engagement of the cylindrical object that is used to be located thereabout for the purpose of gripping and turning of the cylindrical object. The strap wrench also includes a brake that provides for securely locking of the position of the strap when it is in its tightly mounted position preventing any loosening movement of the strap. The brake includes a ratcheting mechanism that permits movement of the handle in only one position when the brake is in the locked position. The strap may include a joint assembly which will permit the strap to be separated to be located in conjunction with a cylindrical object and then rejoined.

11 Claims, 5 Drawing Sheets

STRAP WRENCH FOR GRIPPING AND TURNING GENERALLY CYLINDRICAL OBJECTS

This application is to reference U.S. Provisional Patent Application Ser. No. 60/615,381, filed Oct. 1, 2004, entitled DEVICE FOR GRIPPING AND TURNING GENERALLY CYLINDRICAL OBJECTS, by the present inventor.

BACKGROUND OF THE INVENTION

1. Field of the Invention

A strap wrench for turning of an object which has a general overall cylindrical shape. The typical strap wrench is formed of a handle which has mounted therein the strap. The strap encloses a confined space, and this confining space can be made smaller by turning of the handle thereby tightening of the strap onto the cylindrical object.

2. Description of the Related Art

The subject matter of the present invention is directed to an improvement of the subject matter described within U.S. Pat. No. 6,789,450 which was issued on Sep. 14, 2004 by the present inventor. Many containers that commonly contain food, such as bottles and jars, utilize a cap which is threaded thereon. Sometimes removing of a threaded cap can be difficult for even strong individuals let alone individuals that have handicaps, such as arthritis. In the past, there have been designed strap wrenches to facilitate the removal of such caps. However, the strap wrenches of the prior art have certain deficiencies. One of the deficiencies is that at times the strap will slip on the cylindrical object regardless of how tight the strap is secured thereon. If the strap slips, the ratchet is completely ineffective. Additionally, strap wrenches of the prior art, when fixed in position on the cylindrical object, are required to apply a manual torque maintaining the strap wrench in tight contact with the cylindrical object otherwise the strap wrench would tend to "back off" and become loose and, of course, inoperative. It would be desirable to use some kind of a brake that would be capable of fixing the strap when in the tightened position to prevent the strap from loosening.

The subject matter of this invention is discussed primarily in conjunction with cylindrical objects, such as threaded caps for bottles and jars. However, the subject matter of this invention could be used in conjunction with any such other generally cylindrical objects, such as pipes, fastening nuts, water valve handles, pulleys or any other such device. As far as this invention goes, the generally cylindrical object is meant to include hexagonal shaped threaded nuts, elliptically shaped water valve handles, pipes, as well as container lids.

SUMMARY OF THE INVENTION

A first basic embodiment of the present invention is directed to a strap wrench for gripping and turning generally cylindrical objects where the strap is mounted in conjunction with a handle. The handle is movable to cause loosening and tightening of the strap on the cylindrical object. The strap has mounted thereon a plurality of gripping pads where the gripping pads are resilient functioning to produce a non-slip connection with the cylindrical object.

A further embodiment of the present invention is where the first basic embodiment is modified by defining that each of the gripping pads are movably mounted in conjunction with the strap to provide for adjustment of the gripping pads.

A further embodiment of the present invention is where the first basic embodiment is modified by defining that each gripping pad has an outer surface which is to engage with the cylindrical object and this outer surface is channeled shaped forming a through chamber within which is to be located the cylindrical object to be laterally restrained.

A further embodiment of the present invention is where the first basic embodiment is modified by defining that the outer surface of each gripping pad includes texturing facilitating gripping of the cylindrical object.

A further embodiment of the present invention is where the first basic embodiment is modified by defining that the gripping pads are constructed of rubber.

A second basic embodiment of the present invention is directed to a strap wrench for gripping and turning generally cylindrical objects where the strap is mounted in conjunction with the housing and a handle. The strap encloses a confined space with the housing being located between the confined space and the handle. Each handle is rotatable relative to the housing which will cause the strap to move relative to the housing. A brake is mounted on the housing and this brake is manually settable to fix in position the strap when clamped on the cylindrical object.

A further embodiment of the present invention is where the second basic embodiment is modified by defining that the manual setting of the brake is accomplished by means of a slidable button.

A further embodiment of the present invention is where the second basic embodiment is modified by defining that the brake includes a ratcheting mechanism that permits movement of the handle when tightening of the strap.

A further embodiment of the present invention is where the just previous embodiment is modified by defining that the ratcheting mechanism includes a spring biased metallic latching pawl which rides by a cam on a series of gear teeth formed on the handle.

A further embodiment of the present invention is where the just previous embodiment is modified by defining that the latching pawl has a plastic attachment mounted on the cam.

A third basic embodiment of the present invention is directed to a strap wrench for gripping and turning of generally cylindrical objects where there is a strap mounted in conjunction with the housing on a handle. The strap encloses a confined space and the housing is located between the confined space and the handle. The handle is rotatable relative to the housing which will cause the strap to move relative to the housing. A center gripping pad is fixedly mounted on the housing with the center gripping pad adapted to assist in producing a tight fit on the cylindrical object.

A further embodiment of the present invention is where the third basic embodiment is modified by defining that the exterior surface of the center griping pad is channeled shaped with the cylindrical object to be laterally restrained by the channel.

A further embodiment of the present invention is where the just previous embodiment is modified by defining that the exterior surface of the center gripping pad is textured.

A further embodiment of the present invention is where the just previous embodiment is modified by defining that the center gripping pad is constructed of rubber.

A fourth embodiment of the present invention comprises a strap handle which is mounted in conjunction with a housing. The housing includes a through opening arrangement. A strap terminating in a pair of ends which are connected through the through opening arrangement. The strap extends exteriorly of the housing and defines an enclosing space. A cylindrical object adapted to be located within the enclosing space. The strap has mounted thereon a plurality of gripping pads. A brake is mounted on the housing with the brake being manually settable to fix the strap into position when clamped on the cylindrical object.

A further embodiment of the present invention is where the fourth basic embodiment is modified by defining that each of the gripping pads is channel shaped defining a through chamber with the cylindrical object to be locatable within this through chamber and thereby be laterally restrained by the sidewalls of the chamber.

A further embodiment of the present invention is where the fourth basic embodiment is modified to include a center gripping pad fixedly mounted on the housing with the center gripping pad to assist in applying a tight fit onto the cylindrical object.

A further embodiment of the present invention is where the fourth basic embodiment is modified to state that the brake includes a ratcheting mechanism that permits movement of the handle when tightening of the strap.

A fifth basic embodiment of the present invention comprises a strap wrench which has a housing and a strap terminating in a pair of ends. The ends are mounted in conjunction with the housing. The strap defines an enclosing space with the cylindrical object being adapted to be located within the enclosing space. The housing includes movement means which is to be manually movable to cause tightening of the strap onto the cylindrical object. The strap includes a joint assembly with the joint assembly being movable between a joined position and a separated position. With the joint assembly in the separated position, the strap can be located about a cylindrical object by moving transversely in conjunction with the cylindrical object and then moving of the joint assembly to the joined position.

A further embodiment of the present invention is where the fifth basic embodiment is modified by defining that the joint assembly includes an interlocking groove and ridge arrangement which when interlocked is maintained in an interlocked position by a slidable sleeve.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
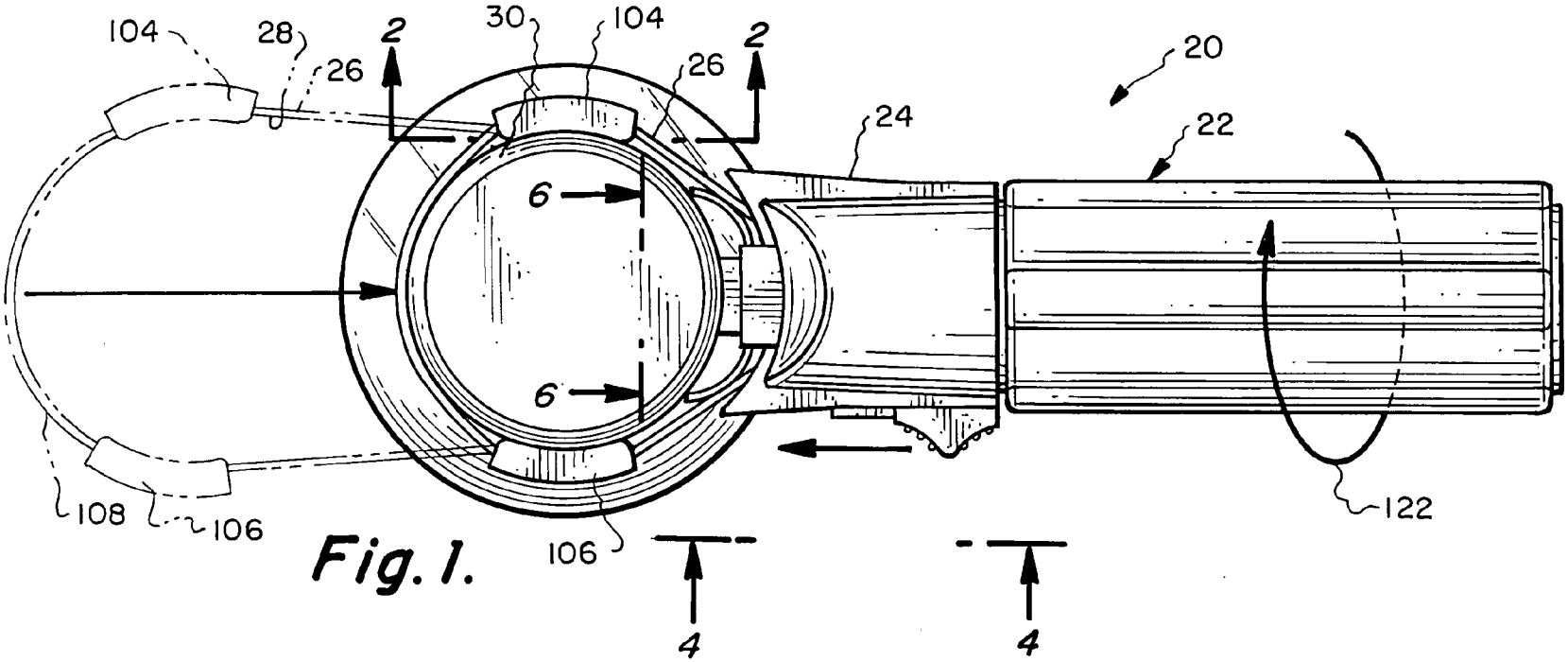
FIG. 1 is a top plan view of the strap wrench of the present invention showing the strap in dotted lines where the strap encloses the largest confined area and in solid lines showing the strap being mounted on a cylindrical object.
Figure 3:
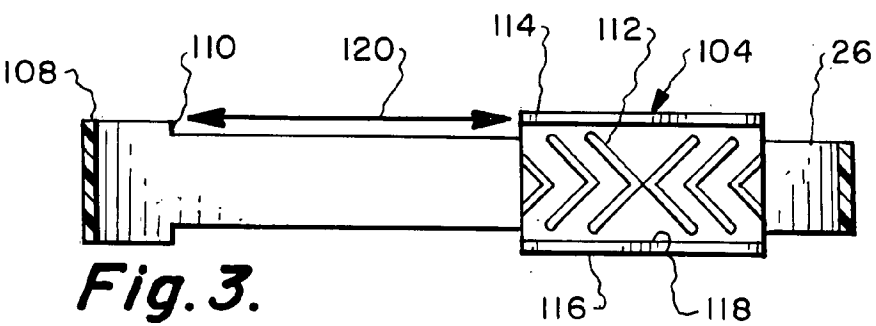
FIG. 3 is a view similar to FIG. 2 but showing where the gripping pad is adjusted to a different position.
Figure 2:
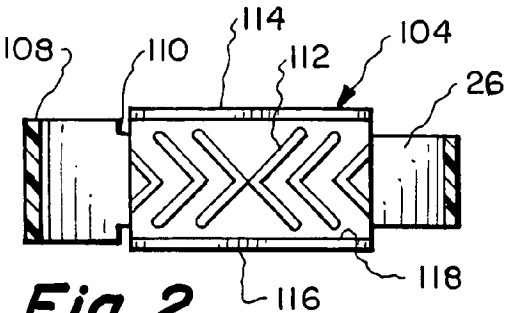
FIG. 2 is a partly cross-sectional view taken along line 2—2 of FIG. 1 showing the outer surface of one of the gripping pads that is mounted on the strap.

Referring particularly to the drawings, there is shown in FIG. 1 the strap wrench 20 of this invention. Basically, the strap wrench 20 includes a handle 22, a housing 24, and a strap 26.

The strap 26 is generally no more than one-half inch wide and about one-eighth inch thick and will normally be constructed of plastic. However, it is considered to be within the scope of this invention that the strap 26 could be constructed of other materials, such as leather and rubber. It is just important that the strap 26 be flexible so as to be bendable to assume a looped configuration, which is shown in dotted lines in FIG. 1. When in the looped configuration, the dotted lines of FIG. 1 the strap 26 encloses a confined area 28. Within this confined area 28 there is to be located the cylindrical object, such as a container lid 30. It is to be understood that the confined area 28 will be made larger than the container lid 30 at which time the container lid 30 will be located within the confined area 28 and then the strap 26 will be tightly clamped onto the peripheral surface of the container lid 30.

The strap 26 terminates in ends 32 and 34. End 32 is fixedly mounted within a slot 36 formed within a nut 38. In a similar manner, the end 34 is mounted within a slot 40 of the nut 38. A pin 42 is mounted through an appropriate hole formed within the nut 38 and is used to lock in position the end 32 by transversely extending through the end 32. In a similar manner, a pin 44 is mounted through a separate hole formed within the nut 38 with the pin 44 passing through the end 34 to lock the end 34 to the nut 38. The nut 38 is formed basically in a cylindrical shape. The peripheral surface of the nut 38 includes an almost three hundred sixty degree spiral protuberance 46. The spiral protuberance 46 is to ride within spiral track 48. Spiral track 48 is mounted within interior wall surface 50 of a hollow tube 52. Hollow tube 52 is open at one end directly adjacent the housing 24 and is closed at the opposite end by a cap 54. Integrally attached to the inside surface of the cap 54 is a centrally located spindle 56 which is conducted through the entire length of the tube 52 and is aligned with the longitudinal center axis of the tube 52. It is to be understood that the tube 52 is cylindrical.

Mounted on the free end of the spindle 56 is a plastic block 58. Plastic block 58 has a square shaped internal chamber 60. Mounted within that chamber 60 is a central gripping pad 62. The central gripping pad 62 is secured by screw fastener 64 which is mounted within a recess 66 formed within the pad 62. The exterior surface of the pad 62 is textured by including a plurality of ridges 68. The upper edge of the pad 62 includes a raised wall 70 and the bottom edge of the pad 62 includes a raised wall 72. The raised walls 70 and 72 function to form a channel shaped chamber 74 within the exterior surface of the pad 62. The block 58 has integrally mounted thereto a left side flange 76 and a right side flange 78. The side flanges 76 and 78 function to keep the different legs of the strap 26 spread apart and avoids there being narrowing the space of the confined area 28. The flanges 76 and 78 also facilitate sliding movement of the strap 26 which it will do when the nut 38 is moved relative to the tube 52 by the spiral protuberance 46 riding within the spiral track 48. This movement is created by a manual turning movement applied to the tube 52 relative with the housing 24 being fixed. To facilitate manual turning of the tube 52, the exterior surface of the tube 52 is covered with a rubberized plastic or other resilient covering 80. It is to be noted that this covering 80 has a series of spaced apart longitudinal smoothly contoured protrusions 82 (four in number) evenly spaced apart. These protrusions 82 facilitate manual grasping and turning of the tube 52.

It is to be understood that manual turning of the tube 52 in such a manner to cause the nut 38 to move from a directly adjacent housing 24 toward cap 54 will result in the confined area 28 to be reduced in size. This is generally referred to as a movement means. It is this movement that will cause tightening of the strap 26 onto the container lid 30. It is to be understood that turning movement in the opposite direction will cause the confined area 28 to be increased in size.

Figure 4:
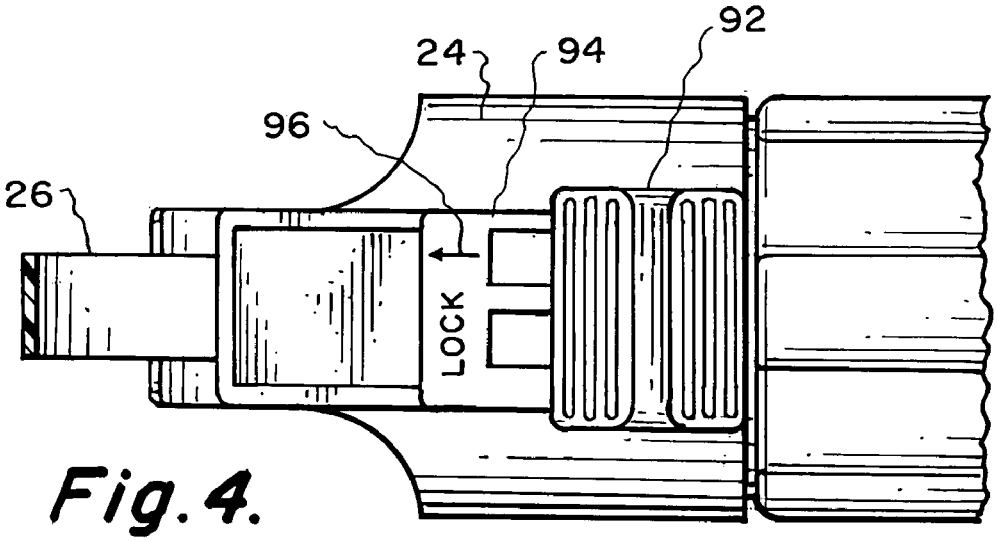
FIG. 4 is a front view taken along line 4—4 of FIG. 1 showing the manually settable button in the released position that is mounted on the housing of the strap wrench of the present invention with this button to be used in order to set the brake that is incorporated with the strap wrench of present invention.
Figure 5:
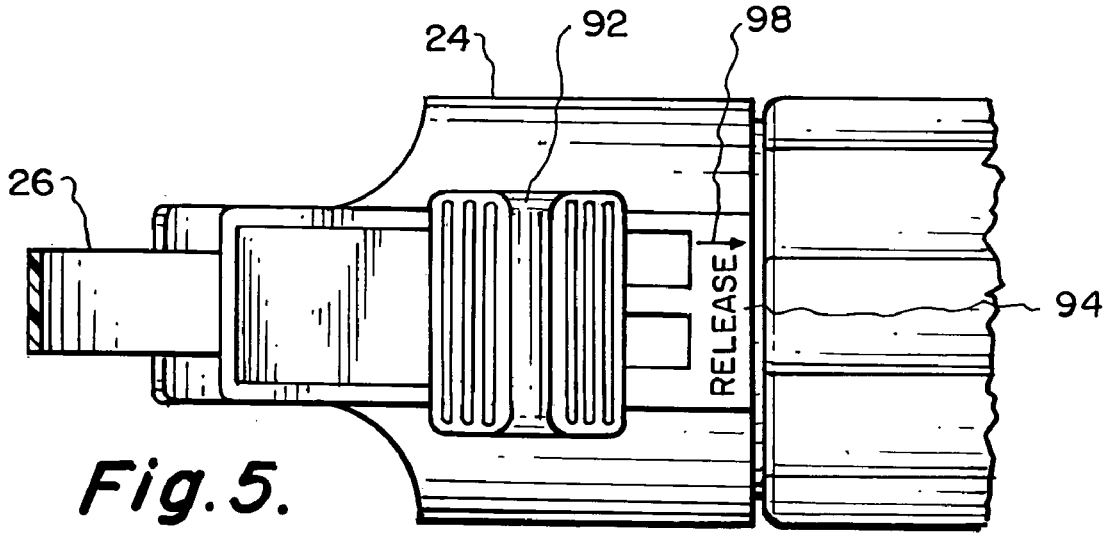
FIG. 5 is a view similar to FIG. 4 but showing the button in the locked position.
Figure 6:
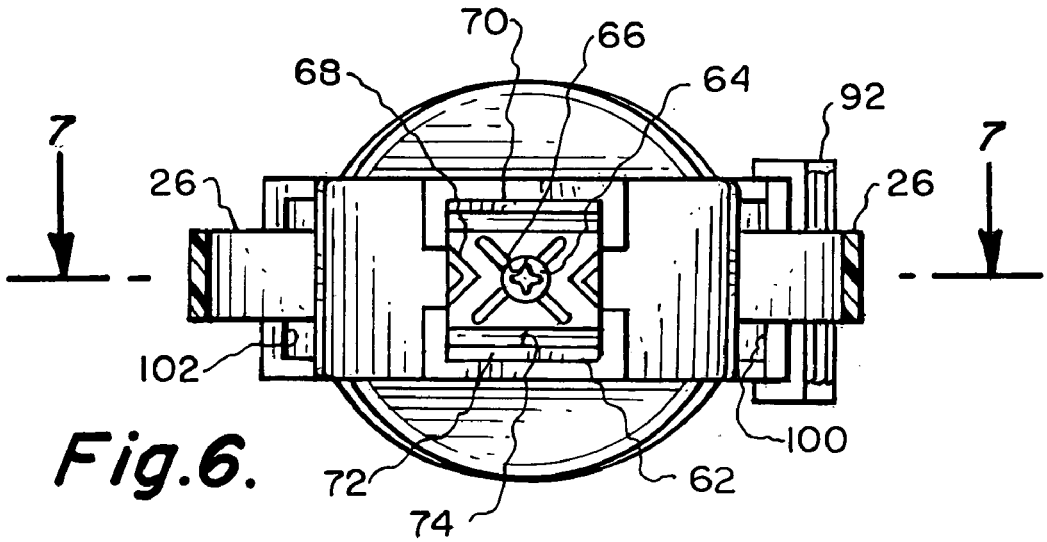
FIG. 6 is a partly cross-sectional view taken along line 6—6 of FIG. 1 showing the exterior surface configuration of the center gripping pad that is mounted in conjunction with the housing that is to be used to press tightly against the cylindrical object on which the strap wrench is mounted.
Figure 7:
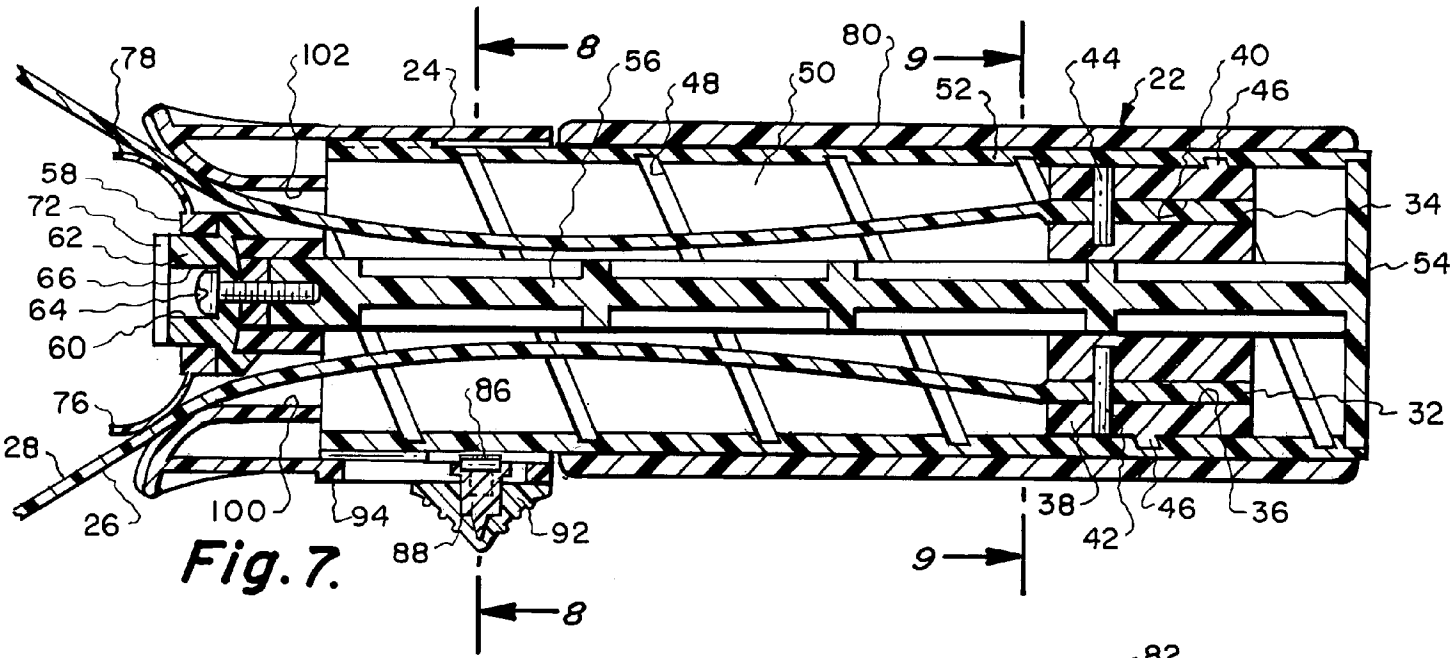
FIG. 7 is a longitudinal cross-sectional view through the handle and housing of the strap wrench of the present invention taken along line 7—7 of FIG. 6.
Figure 9:
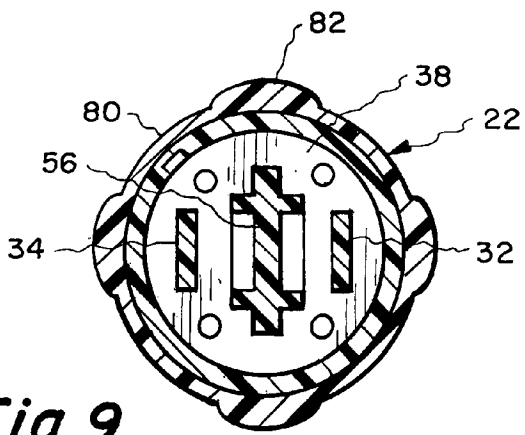
FIG. 9 is a transverse cross-sectional view taken along line 9—9 of FIG. 7 showing one end of the movable nut that is incorporated in conjunction with the handle of the strap wrench of the present invention.
Figure 8:
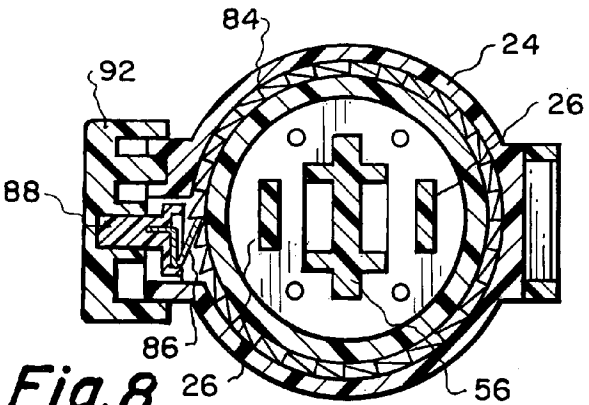
FIG. 8 is a transverse cross-sectional view taken through the housing and handle and manually settable button when the button is in the release position taken along line 8—8 of FIG. 7.

The exterior surface of the tube 52, located directly adjacent the housing 24 and also directly adjacent the open end of the tube 52, includes a series of gear teeth 84. The gear teeth 84 are to be continuously engaged by a pawl 86. The pawl 86 is constructed of metal and has a certain inherent springiness. The outer end of the pawl 86 is mounted within mounting block 88. The mounting block 88 is in turn mounted within a cavity 90 that is formed within a button 92. Button 92 is mounted on the exterior surface of the housing 24. The housing 24 includes a flat section 94 on which the slidable button 92 rests. The button 92 is capable of sliding movement on the flat section 94 between a release position, shown in FIG. 4, and a locked position, shown in FIG. 5. With the button 92 in the release position, the pawl 86 is longitudinally spaced from the gear teeth 84 and not in engagement with such.

When the strap 26 is in tight engagement with the container lid 30, the user will then apply to the covering 80 a slightly extra turning motion which will insure that the strap 26 is in really tight engagement with the container lid 30. At this time, the user then slides button 92 with his or her thumb from the release position of FIG. 4 to the locked position of FIG. 5. It is to be noted that the flat section 94 indicates by arrow 96 and the word "lock" to the user what direction is the lock position. It is also to be noted that the flat section 94 includes the word release right next to arrow 98 which will indicate to the user what direction the button 92 must move in order to move to the release position. The movement of the button 92 to the lock position will result in the pawl 86 being moved in engagement with the gear teeth 84. Each of the gear teeth 84 has a vertical wall and a slanted wall. The pawl 86 will abut against one of the vertical walls of one of the gear teeth 84. This will produce a locking action preventing pivotable movement of the covering 80 and tube 52 in a direction that would loosen the strap 26. Therefore, the button 92 functions as a brake. However, it is noted that because of the inclined surface of each of the gear teeth 84, if the user wishes at this time to apply a further tightening torque to the cover 80 and tube 52, that the user is able to do so with the pawl 86 sliding over the inclined surface of the gear teeth 84 and then will be biased back to engage a vertical wall of one of the gear teeth 84 thereby producing the lock again. The housing 24 has a pair of through openings 100 and 102. One portion of the strap 26 extends through the opening 100 and another portion of the strap 26 extends through the opening 102 prior to the ends 32 and 34 being connected to the nut 38.

In order to facilitate gripping of the container lid 30, there is mounted on the strap 26 a pair of diametrically spaced apart gripping pads 104 and 106. The portion of the strap 26 on which the gripping pads 104 and 106 are mounted is slightly narrower than the apex section 108. Because the apex section 108 is wider than the remaining portion of the strap 26, there is produced a pair of shoulders with only one shoulder 110 being shown which is to be capable of functioning as a stop to limit the movement of the gripping pad 104. It is to be understood that there is a similar shoulder that will function to limit the movement of the gripping pad 106. It is to be understood that the gripping pads 104 and 106 are movable on the strap 26. The movement of the gripping pads 104 and 106 are not easily movable on the strap 26 but are capable of being moved by exerting a small amount of pulling force. This movement of the gripping pads 104 and 106 is to permit adjustment to different diameter of container lids 30 or other cylindrical objects so that the gripping pads 104 and 106 will be located at their optimum position. The typical optimum position is, as is shown in FIG. 1, with the gripping pads 104 and 106 located diametrically opposite each other with their alignment axis being perpendicular to the longitudinal center axis of the handle 22 and housing 24.

Figure 10:
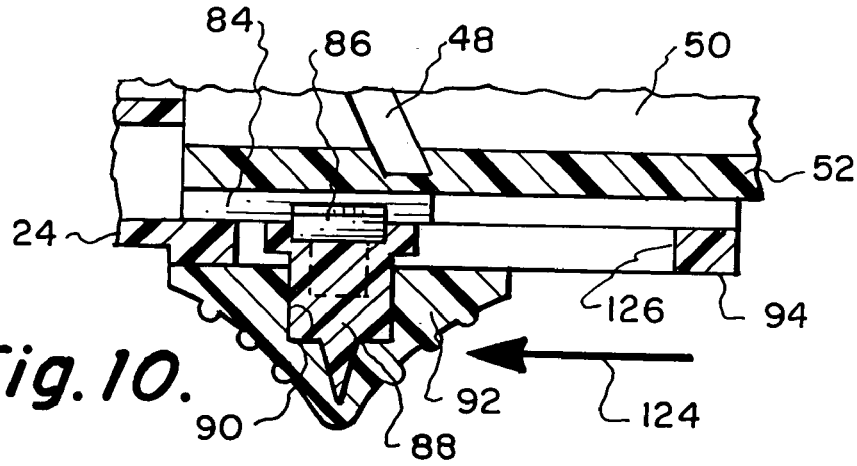
FIG. 10 is a cross-sectional view of the slidable button that is used in conjunction with the brake of the strap wrench of the present invention which is similar to what is shown in FIG. 7 except that the slidable button is in the locked position.

The outer surface of each of the gripping pads 104 and 106 includes an arrangement of protrusions 112 which constitute a texturing which will facilitate the grasping onto the container lid 30. Also, each gripping pad 104 and 106 includes a pair of raised walls 114 and 116 which produce a through channel 118 located therebetween. The width area of the container lid 30 is to be located within this through channel 118 so that the container lid 30 is laterally restrained to insure that the strap 26 will not be capable of sliding out of engagement with the container lid 30. It is to be noted that movement of the gripping pads 104 and 106 is to be accomplished, as indicated by arrow 120. It is also to be noted that turning of the handle 22 to achieve tightening of the strap 26 on the container lid 30 is in the direction as indicated by arrow 122 shown in FIG. 1. The arrow 124 in FIG. 10 indicates the movement of the button 92 from the release position to the lock position. The movement of the button 92 between the release position and the lock position is permitted by elongated slot 126 formed within the housing 124. The mounting block 88 is mounted within this elongated slot 126.

Figure 11:
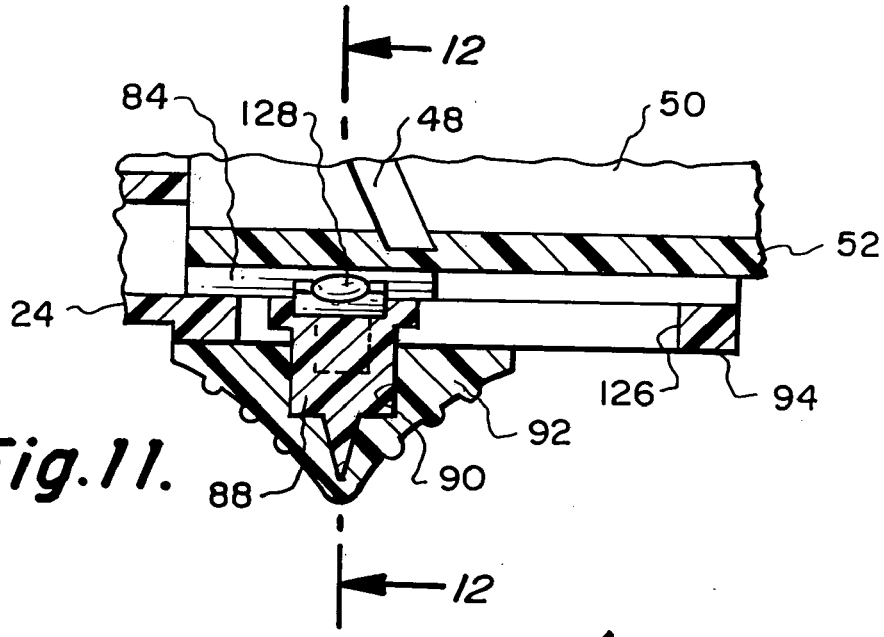
FIG. 11 is a view similar to FIG. 10 except there is shown a modified form of ratcheting structure which is incorporated in conjunction with the slidable button.
Figure 12:
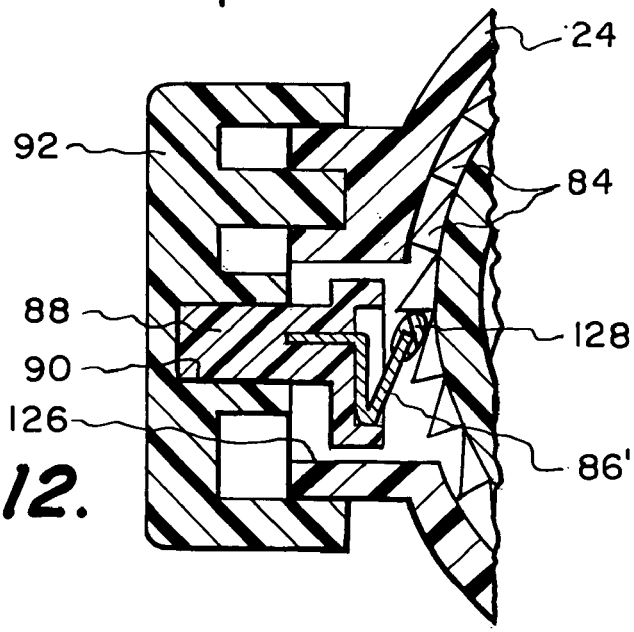
FIG. 12 is a cross-sectional view taken along line 12—12 of FIG. 11.
Figure 13:
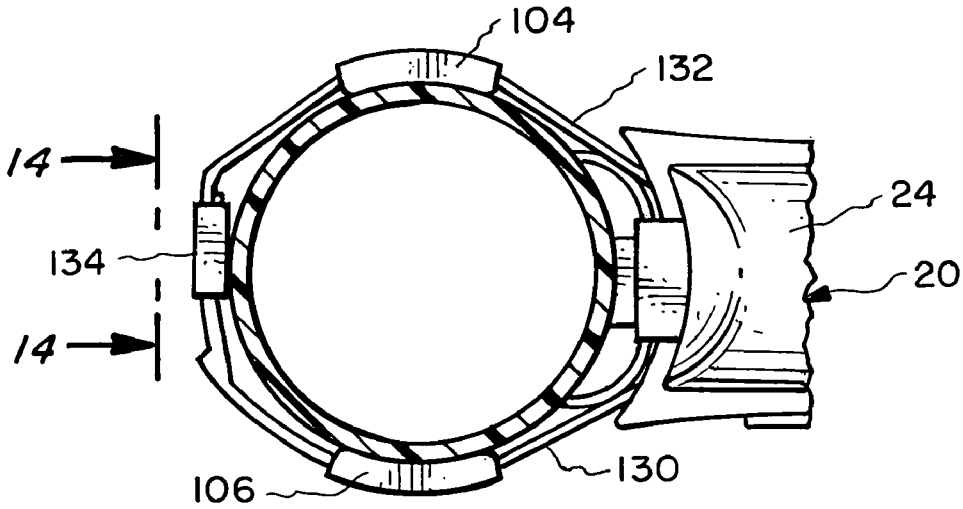
FIG. 13 is a view similar to FIG. 1 but with the cylindrical object on which the strap is mounted is cross-sectioned and the strap is modified to include a joint.
Figure 14:
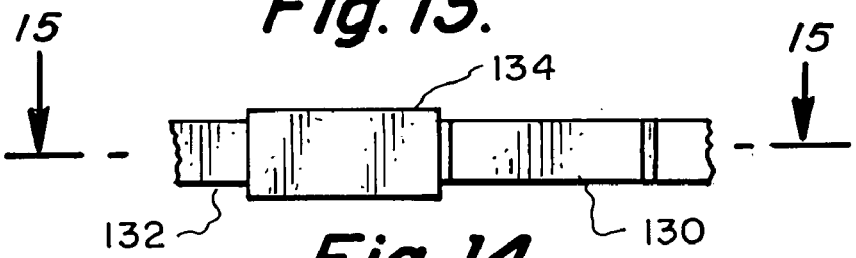
FIG. 14 is a view of the joint taken along line 14—14 of FIG. 13.
Figure 15:
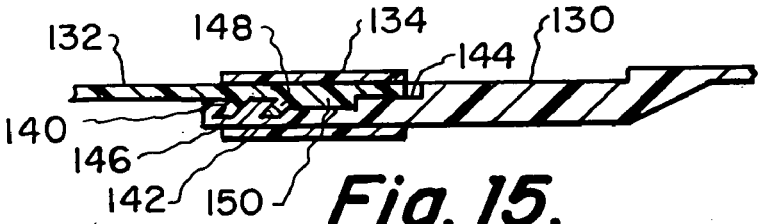
FIG. 15 is a longitudinal cross-sectional view through the joint assembly taken along line 15—15 of FIG. 14 where the joint assembly is in the joined position.

Referring particularly to FIGS. 11 and 12, there is shown a modified version of pawl 86 which is to be referenced pawl 86'. The pawl 86' includes a plastic section 128 which rides against the gear teeth 84. The plastic section 128 facilitates the slipping movement on the gear teeth 84 and also diminishes the creation of noise due to the ratcheting action of the pawl 86' as it slips on the gear teeth 84 during the final tightening movement of the strap 26 on the container lid 30.

Referring particularly to FIGS. 13–16, there is shown a different embodiment utilizing the same handle 20 which includes a housing 24 which has a pair of through openings, which are not shown. Within one of the through openings is mounted one end of a strap 130. Within the other of the through openings is mounted one end of a strap 132. A gripping pad 104 is mounted on strap 132. A gripping pad 106 is mounted on strap 130.

Strap 130 has a slidable sleeve 134 mounted thereon. Strap 130 includes a channel 136 with the floor 138 of the channel 136 including a pair of transverse grooves 144. The strap 132 has a pair of spaced apart inclined ridges 146 and 148. The strap 132 also includes a short longitudinal ridge 150.

The grooves 140, 142 and 144 and the ridges 146, 148 and 150 along the sleeve 134 comprises a joint assembly. The movable sleeve 134 can be moved so that the ridges 146, 148 and 150 can be respectively disengaged from grooves 130, 142 and 144 so that the strap 132 can be separated from strap 130. This will permit the straps 130 and 132 to be located about a cylindrical object by moving transversely in conjunction with the cylindrical object. The embodiments of the invention shown in FIGS. 1–12 requires that the strap 26 be connected to the cylindrical object by being longitudinally slid over an end of the cylindrical object. The embodiment of FIGS. 13–16 does not require this longitudinal sliding engagement. The embodiment of FIGS. 13–16 will be usable in conjunction with pipes that are fixed at each end to some kind of a connection.

With strap 130 and 132 separated and these straps located about the cylindrical object, the ridges 146, 148 and 150 are manually located in conjunction with the grooves 140, 142 and 144 respectively. The strap 132 is located within the channel 136. The sleeve 134 can then be slid over the strap 132 which will produce an interlocking connection between straps 130 and 132. Tightening movement of the strap wrench of FIGS. 13–16 will only cause the ridges 146 and 148 to be moved into further tight engagement with grooves 140 and 142 because such are inclined in a general direction toward the direction of tightening movement.

Figure 16:
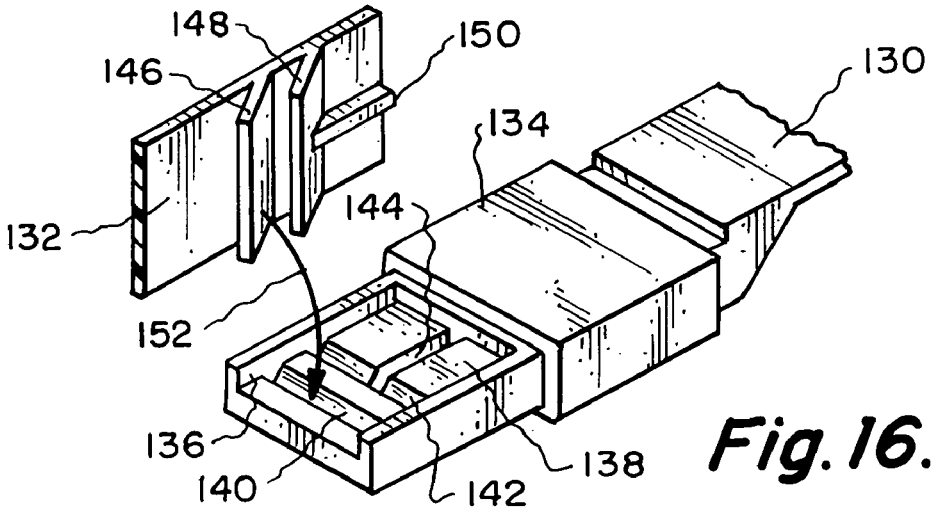
FIG. 16 is an isometric view of the joint assembly showing the joint assembly in the separated position.

The interconnecting movement of strap 132 with strap 130 is depicted generally by arrow 152 in FIG. 16. However, in actual practice, this connecting movement will be when strap 132 is merely slid longitudinally in conjunction with strap 130. This transverse connecting movement of FIG. 16 is shown only to facilitate the description of the invention.

It is to be understood that to disconnect the straps 130 and 132, the movable sleeve 134 must be slid back along strap 130 to permit strap 132 to be disengaged from strap 130.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A strap wrench for gripping and turning generally cylindrical objects comprising:

a strap mounted in conjunction with a handle, said handle being movable to cause loosening and tightening of said strap on a cylindrical object;

said strap having mounted thereon a plurality of gripping pads, whereby said gripping pads being resilient functioning to produce a non-slip connection with the cylindrical object; and each gripping pad being movably mounted on said strap to permit adjustment of said gripping pad to accommodate to different diameters of cylindrical objects.

2. A strap wrench for gripping and turning generally cylindrical objects comprising:

a strap mounted in conjunction with a handle, said handle being movable to cause loosening and tightening of said strap on a cylindrical object;

said strap having mounted thereon a plurality of gripping pads, whereby said gripping pads being resilient functioning to produce a non-slip connection with the cylindrical object; and each said gripping pad having an outer surface which is to engage with the cylindrical object; and each said gripping pad having an outer surface which is to engage with the cylindrical object, each said outer surface being channeled shaped forming a through chamber within which is to be located the cylindrical object with the cylindrical object being restrained laterally.

3. A strap wrench for gripping and turning of generally cylindrical objects comprising:

a strap mounted in conjunction with a housing and a handle, said strap enclosing a confined space, said housing located between said confined space and said handle, said handle being rotatable relative to said housing which will cause said strap to move relative to said housing;

a brake mounted on said housing, said brake being manually settable to fix in position said strap when clamped on the cylindrical object; and said brake including a ratcheting mechanism that permits movement of said handle when tightening of said strap.

4. The strap wrench as defined in claim 3 wherein:

Said ratcheting mechanism including a spring biased metallic latching pawl which rides by a cam on a series of gear teeth formed on said handle.

5. The strap wrench as defined in claim 4 wherein:

said latching pawl having a plastic attachment mounted on said cam, said plastic attachment for providing a smooth, slipping surface when said latching pawl ratchets.

6. A strap wrench for gripping and turning of generally cylindrical objects comprising:

a strap mounted in conjunction with a housing and handle, said strap enclosing a confined space, said housing located between said confined space and said handle, said handle being rotatable relative to said housing which will cause said strap to move relative to said housing;

a center gripping pad fixedly mounted on said housing, said center gripping pad adapted to be used to help apply a tight fit onto the cylindrical object; and said center gripping pad having an exterior surface, said exterior surface being channeled shaped forming a through chamber in the cylindrical object to be laterally restrained by being mounted within said chamber.

7. The strap wrench defined in claim 6 wherein:

said exterior surface being textured for the purpose of forming a non-slip surface.

8. The strap wrench defined in claim 7 wherein:

said center gripping pad being constructed of rubber.

9. A strap wrench for grippingg and turning of generally cylindrical objects comprising:

a turnable handle;

a housing located directly adjacent one end of said handle, said handle being pivotally movable relative to said housing, said housing including a through opening arrangement;

a strap terminating in a pair of ends which are conducted through said through opening arrangement, said strap extending exteriorly of said housing and defining an enclosing space, a cylindrical object is adapted to be located within said enclosing space, said strap having mounted thereon a plurality of gripping pads;

a brake mounted on said housing, said brake being manually settable to fix said strap in position when clamped on the cylindrical object; and each of said gripping pads is channeled shaped defining a through chamber with the cylindrical object to be locatable within said through chamber and thereby be laterally restrained by said sidewalls of said through chamber.

10. A strap wrench for gripping and turning of generally cylindrical objects comprising:

a turnable handle;

a housing located directly adjacent one end of said handle, said handle being pivotally movable relative to said housing, said housing including a through opening arrangement;

a strap terminating in a pair of ends which are conducted through said through opening arrangement, said strap extending exteriorly of said housing and defining an enclosing space, a cylindrical object is adapted to be located within said enclosing space, said strap having mounted thereon a plurality of gripping pads;

a brake mounted on said housing, said brake being manually settable to fix said strap in position when clamped on the cylindrical object; and said brake including a ratcheting mechanism that permits movement of said handle when tightening of said strap.

11. A strap wrench for gripping and turning of generally cylindrical objects comprising:

a housing;

a strap terminating in a pair of ends, said ends mounted in conjunction with said housing, said strap defining an enclosing space, a cylindrical object is adapted to be located within said enclosing space;

said housing including movement means which is to be manually movable to cause tightening of said strap on the cylindrical object;

said strap including a joint assembly, said joint assembly being movable between a joined position and a separated position, whereby said joint assembly in said separated position said strap can be located about a cylindrical object by moving transversely in conjunction with the cylindrical object and then moving of said joint assembly to said joined position; and said joint assembly including an interlocking groove and ridge arrangement which when interlocked is maintained in an interlocked position by a slidable sleeve.

* * * * *